US006134714A

United States Patent [19]

Uglene

[11] Patent Number: 6,134,714

[45] Date of Patent: Oct. 24, 2000

[54] ENHANCED PERSONAL COOLING GARMENT

[75] Inventor: Wendell Vaughn Uglene, Surrey, Canada

[73] Assignee: Mustang Survival Corp., Richmond, Canada

[21] Appl. No.: 09/289,744

[22] Filed: Apr. 12, 1999

[51] Int. Cl.[7] ..... A41D 1/04

[52] U.S. Cl. ..... 2/102; 2/69; 2/81

[58] Field of Search ..... 2/69, 78.3, 253, 2/272, DIG. 1, DIG. 3, 81, 102

[56] References Cited

U.S. PATENT DOCUMENTS

| | | | |
|---|---|---|---|
| 4,242,769 | 1/1981 | Rayfield et al. | 441/91 |
| 5,243,706 | 9/1993 | Frim et al. | 2/455 |
| 5,320,164 | 6/1994 | Szczesuil et al. | 165/46 |
| 5,538,583 | 7/1996 | Szczesuil et al. | 156/291 |
| 5,722,482 | 3/1998 | Buckley | 165/10 |
| 5,755,275 | 5/1998 | Rose et al | 165/46 |
| 5,970,519 | 10/1999 | Weber | 2/81 |

FOREIGN PATENT DOCUMENTS 2051358 3/1997 Canada .

*Primary Examiner*—John J. Calvert
*Assistant Examiner*—Robert H. Muromoto, Jr.
*Attorney, Agent, or Firm*—C. A. Rowley

[57] ABSTRACT

An enhanced personal cooling garment has an inner layer and outer layer that define a confined space or bladder therebetween for containing liquid water. The inner and outer layer are thin materials that are impermeable to both air and liquid water yet permeable to water vapour. The garment is worn in a manner such that the innermost layer is in direct contact with the wearer's skin. The liquid water between the layers diffuses as vapour through the outer layer; it removes latent heat required for evaporation hence provides cooling to the human body. As both layers of the garment are permeable to water vapour, sweat produced by the wearer can diffuse through the innermost layer, where it will then condense into liquid. When worn beneath an air-cooling garment that distributes cool; dry air over the body, the rate of evaporation increases, resulting in even greater enhancement of cooling of the wearer.

20 Claims, 4 Drawing Sheets

ENHANCED PERSONAL COOLING GARMENT

FIELD OF THE INVENTION

The present invention relates to a cooling garment, more particularly, the present invention relates to a water vapour permeable liquid-filled garment that is worn next to the skin to enhance cooling of the wearer.

BACKGROUND OF THE PRESENT INVENTION

Air-cooling garments are used by military and civilian agencies for protection of personnel against heat stress. These air-cooling garments are worn during normal operations and provide cooling by delivering cool, dry air over the body (primarily the torso). Cooling is achieved by increasing conduction, convection, and the rate of evaporation of sweat.

These garments remove the greatest amount of heat when the skin and underclothing beneath the air-cooling garment are saturated with sweat. Sweating the body's natural cooling mechanism occurs when the subject is overheated and may either nearing or be suffering from heat stress. Therefore, air-cooling garments tend to function most effectively when the subject is already on the way towards becoming heat stressed. Even mild heat stress is known to reduce both comfort and hence degrades wearer's cognitive and physical performance. Extreme heat stress can lead to unconsciousness and/or death.

The concepts of air cooling garments appear in the patent literature, for example, in Canadian Patent No. 2,051,358.

BRIEF DESCRIPTION OF THE PRESENT INVENTION

It is the main objective of the present invention to provide an improved cooling garment or suit that is particularly effective when worn beneath or when integrated with an air-cooling garment.

Broadly, the present invention relates to a cooling garment comprising a water vapour permeable, liquid water and air impermeable inner layer and a water vapour permeable, water and air impermeable outer layer, said inner and outer layers being secured together at spaced locations to define a confined space forming a bladder for containing liquid water therein, said bladder extending over a major portion of the area of the garment, said garment being constructed to be in snug fitting relationship with the wearer.

Preferably, said garment is formed by a plurality of garment portions secured together and the bladder is therefor formed or a plurality of individual bladders one in each of said portions.

Preferably, a tubing network interconnects the bladders with a source of water under pressure.

Preferably the breathing surface area of the garment is at least 75% of the area of the garment portions.

Preferably the bladder has depth measured between the inner and outer layers of less than 1.5 millimeters (mm).

Preferably, said inner layer is a stretchable under normal operating conditions to improve said snug fit with said wearer.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1A:
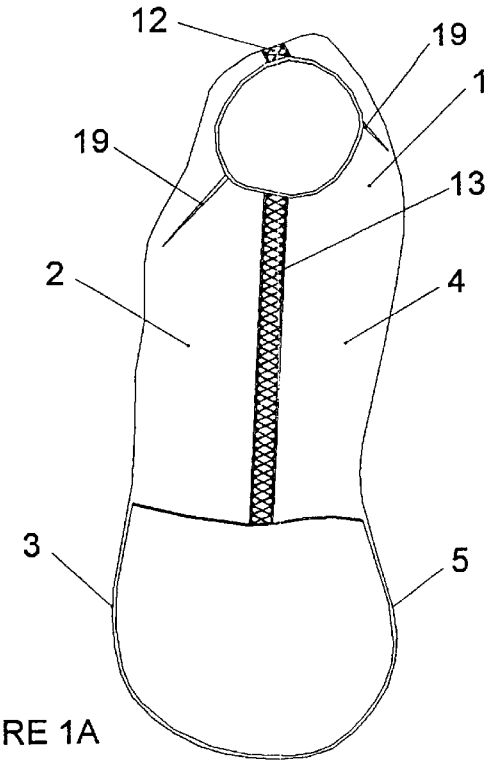
FIG. 1A is a schematic illustration of a garment constructed in accordance with the present invention viewed from one side of the garment.
Figure 1B:
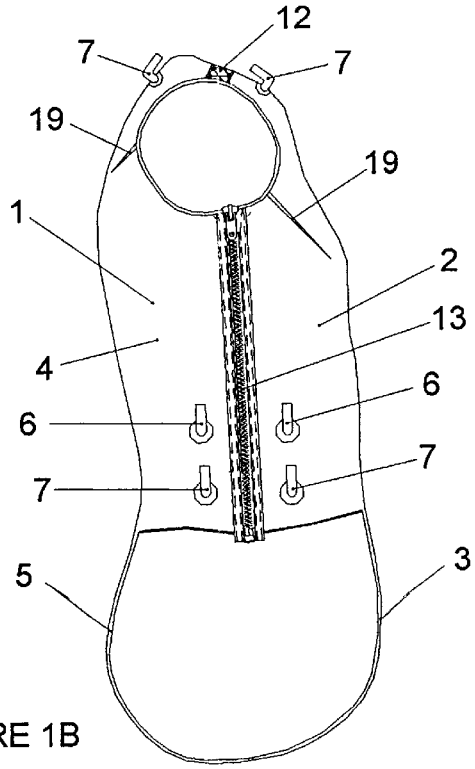
FIG. 1B is a schematic illustration of a garment constructed in accordance with the present invention viewed from the opposite side to that shown in FIG. 1A.
Figure 1C:
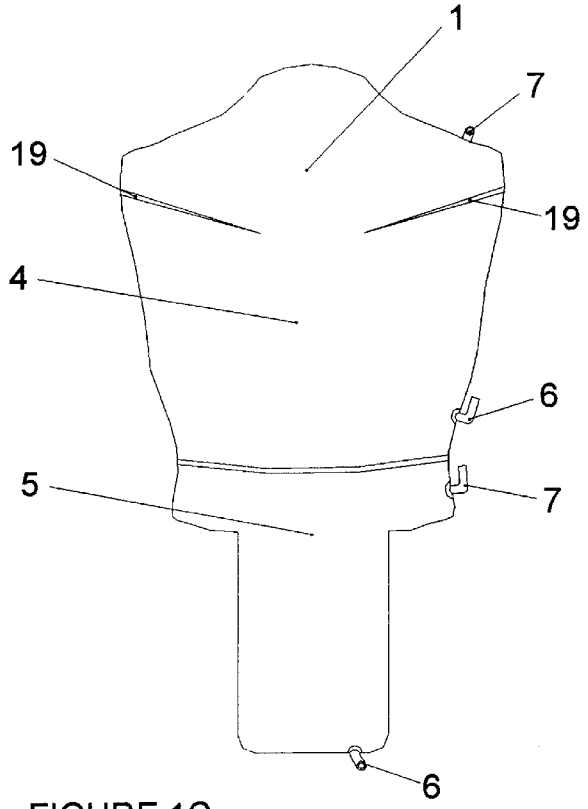
FIG. 1C is a schematic illustration of a garment constructed in accordance with the present invention viewed from the front of the garment.
Figure 1D:
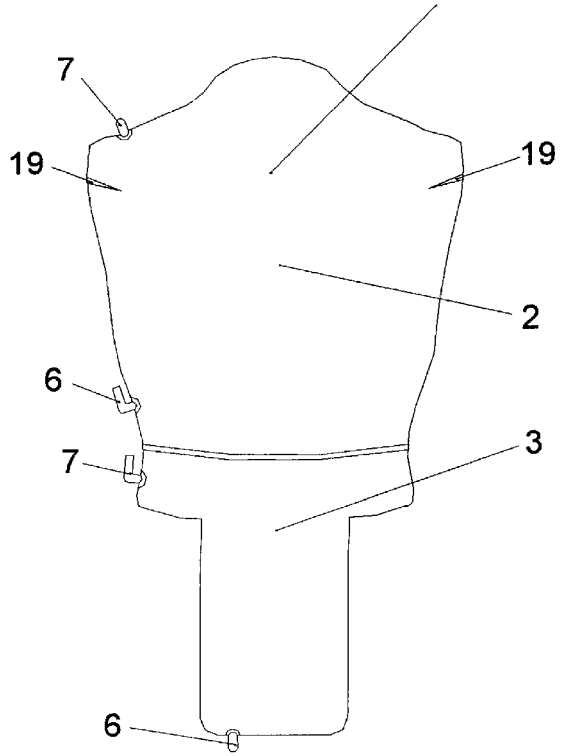
FIG. 1D is a schematic illustration of a garment constructed in accordance with the present invention viewed from the rear of the garment.

As shown in FIG. 1, the garment 1 of the present invention is composed of a plurality of separate garment parts or portions that are secured together by a suitable seam structure to form the desired garment preferably welding or otherwise securing them together.

The illustrated arrangement, garment 1 includes a chest portion 2, abdomen 3, back 4, and buttocks 5. Each of these portions, 2, 3, 4, etc. will form a separate bladder 17 (see FIG. 2A) as will be described below.

The illustrated suit 1 has either zippers or lacing along the shoulders 12 and sides of the torso 13. It is important to the garment's function that the inner layer 15 be snug fitting and be in direct contact with the wearer's skin. Individual garment portions 2, 3, 4, etc. may be molded in order to ensure form fitting. Darts 19 or any other suitable means may be used to ensure the garment is snug fitting i.e. form fitting with the wearer.

Figure 2:
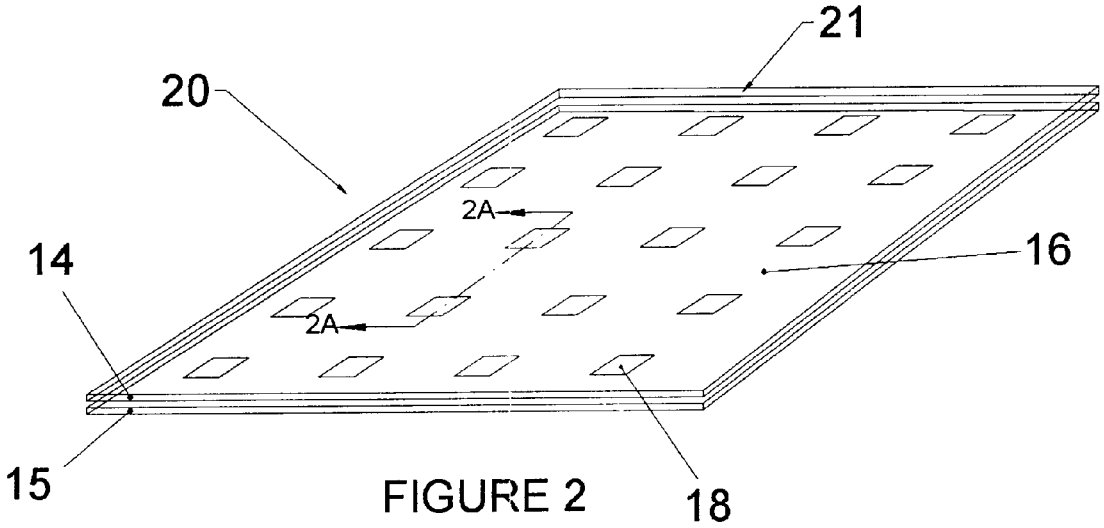
FIG. 2 is an isometric illustration of a panel used to form the portions of the garment of the present invention constructed of an inner and outer layer secured together to form a bladder therebetween.
Figure 2A:
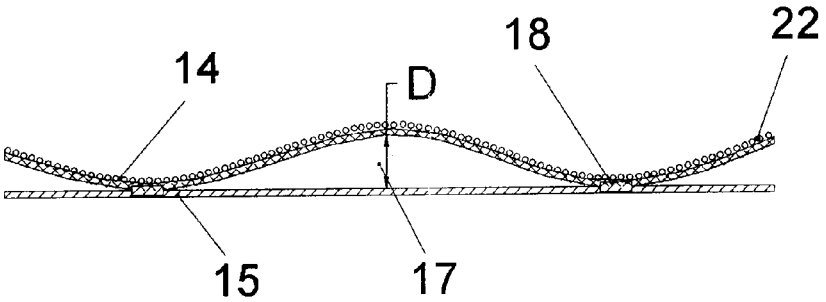
FIG. 2A is a schematic illustration through the wall of the garment along the line 2A—2A of FIG. 2 illustrating the fabric layers forming a bladder therebetween as used in the present invention.

Referring to FIGS. 2 and 2A, each of the garment portions 2, 3, 4, etc will be constructed in a similar way and will be formed from panels 20 each composed of an outer layer 14 and an inner layer 15, both of which are preferably substantially air and liquid impermeable yet water vapour permeable.

The outer layer 14 is stretchable under normal conditions and will normally be made from a polyurethane-coated stretch nylon fabric 22 preferably of at least 70 denier and less than 200 denier and having a thickness of 0.7 mm.

The inner layer 15 is also stretchable under normal operating conditions to enhance the snugness of the fit of the garment to the wearer and will normally be made from a polyurethane stretch film having a thickness in the order of about 0.3 mm.

It is important to the garment's function that the resistance to water vapour diffusion of each of these two layers 14 and 15 is as low as possible, preferably, equivalent to the diffusion resistance of between 0.1 to 3.0 mm of still air.

The outer layer 14 and inner layer 15 are preferably welded together to form panels 20 using a dot matrix pattern 16 as schematically shown in FIG. 2. The inner layer 15 is preferably maintained substantially flat while the outer layer 14 forms a more wavy pattern when the layers 14 and 15 are welded together. Welding of the two layers together creates a confined space or bladder 17 forming a breathing surface extending over a major portion of the area of the garment portions 2, 3, 4, etc in which it is formed. Generally the average breathable surface area of the garment portion 2, 3, 4, etc will extend over at least 70% preferably 75%) of their surface areas.

The bladder 17 is formed to permit the passage of liquid water and air though out it area during filling and to provide a layer of water over the area of the garment defined by the bladder 17 when in use. The pattern 16 of dot or patch welds 18 restricts expansion of the garment thus minimizing the garment's resistance to both heat and moisture transport. Generally the maximum depth D of spacing between the inner and outer walls 14 and 15 when filled with water under normal operating pressure will be in the order of no greater than 1.5 mm. Obviously with no water in the bladders i.e. no internal pressure the depth D will be quite small normally in the order of less than about 0.2 mm.

It will be apparent that the overall bladder 17 in the illustrated arrangement is composed of a plurality of individual bladders 17 one in each of the portions 2, 3, 4, etc.

The applicant has found that when the welded region 18 comprises 23% of the garment's total surface area when the matrix 16 is comprised of 1/16" (1.6 mm) square dots spaced apart by 1/8" (3.2 mm) from edge to edge was very effective for carrying out the present invention, but clearly other suitable weld patterns and sizes can be used to achieve essentially the same results.

The outer layer 14 and inner layer 15 are welded or otherwise seamed together by continuous seams around their peripheries as schematically indicated at 21 in FIG. 2 to define a garment portion and to form each such garment portion 2, 3, 4 etc as water vapour permeable, air and liquid water-tight bladder i.e. to define the outer periphery of confined space or bladder 17 between the inner 15 and outer 14 layers. These garment portions 2, 3, 4 etc. as above indicated are welded or otherwise secured together to form the garment 1.

Figure 3:
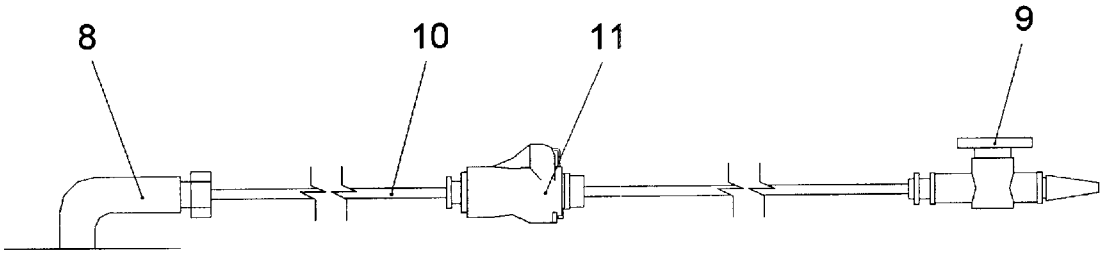
FIG. 3 is a schematic illustration of the water feed system used for filling the vest with water (and/or replenishing the water continuously or as required).

Referring to FIG. 3, each bladder 17 i.e. the bladder in each of the portions 2, 3, 4 etc, will preferably be provided with separate water ingress 6 and air egress fittings 7 interconnected by nipples 8, valves 9, tubing 10 and quick-disconnects 11. In some cases two portions or bladders may be connected in series via tubing 10 e.g. with water entering one and air passing out the other.

Initially during filling, both valves 9 (only one shown) for the air bleed 7 and water feed 6 are open. As water is forced into the empty bladder(s) 17 under pressure, air is displaced from the bladder 17. Once the bladder(s) 17 are filled completely with water and all air exhausted, both valves 9 for the air bleed 7 and water feed 6 can be closed. If constant water feed source is used, then only the air bleed 7 is closed; water feed 6 is left open. In a stand-alone mode after the bladders 17 have been filled the tubing network formed by the tubing 10, is unnecessary up to the quick-disconnect 11 and may be removed. In constant feed operation wherein water under appropriate pressure is being fed to the bladders 17 constantly the tubing network remains in place.

Liquid water is input to the each portion of the garment 1 from an external reservoir (not shown) via the network of tubes 10, quick disconnects 11, valves 9 and nipples 8. Hydrostatic pressure at least sufficient to distribute the water but generally not more than a maximum of 3.5 lb/in$^2$, is necessary for water ingress. While a liquid water source is necessary only for initial filling of the garment, certain applications may required that it be connected to provide constant feed to the garment, in order that water lost from the garment via evaporation is automatically replenished.

In operation the garment is worn in a manner such that the innermost layer is in direct contact with the wearer's skin. The liquid water between the layers 14 and 15 i.e. in the bladder 17 diffuses as vapour through the outer layer, it removes latent heat required for evaporation hence provides cooling to the human body. As both layers of the garment are permeable to water vapour, sweat produced by the wearer can diffuse through the innermost layer, where it will then condense into liquid. When worn beneath an air-cooling garment that distributes cool; dry air over the body, the rate of evaporation increases, resulting in enhancement of cooling of the wearer. As above described, if desired the bladders may be connected to a source of water under selected pressure and so that the water in the bladder is added automatically as required to maintain the pressure in the bladder.

The fact that the both the inner layer 14 and outer layer 15 are stretchable results in both layers expanding when water under pressure fills the bladder(s) 17 so that the donned and then filled garment more snugly embraces the wearer.

The cooling fluid has been described as water but it will be apparent that other cooling fluids with appropriate characteristics of evaporation rate and permeability through the materials of layers 14 and 15 may be used, thus it is intended the term water be interpreted accordingly.

Having described the invention, modifications will be evident to those skilled in the art without departing from the scope of the invention as defined in the appended claims.

I claim:

1. An enhanced personal cooling garment comprising a water vapour permeable, liquid water and air impermeable inner layer and a water vapour permeable, water and air impermeable outer layer, said inner and outer layers being secured together at space locations to define a confined space forming a bladder for containing liquid water therein, said bladder defining a breathing surface for water vapour extending over a major portion of the area of the garment, said garment being constructed to be in snug fitting relationship with the wearer.

2. An enhanced personal cooling garment as defined in claim 1 wherein said garment is formed by a plurality of garment portions secured together and wherein said bladder or a plurality of individual bladders is informed one in each of said portions.

3. An enhanced personal cooling garment as defined in claim 1 wherein said major portion comprises at least 75% of said area of said garment.

4. An enhanced personal cooling garment as defined in claim 2 wherein said major portion comprises at least 75% of said area of said garment portions.

5. An enhanced personal cooling garment as defined in claim 1 wherein said bladder has depth measured between said inner and outer layers of less than 1.5 millimeters.

6. An enhanced personal cooling garment as defined in claim 2 wherein each said individual bladder has depth measured between said inner and outer layers of less than 1.5 millimeters.

7. An enhanced personal cooling garment as defined in claim 3 wherein said bladder has depth measured between said inner and outer layers of less than 1.5 millimeters.

8. An enhanced personal cooling garment as defined in claim 4 wherein each said individual bladder has depth measured between said inner and outer layers of less than 1.5 millimeters.

9. An enhanced personal cooling garment as defined in claim 1 wherein said inner layer is stretchable under normal operating conditions to improve said snug fit with said wearer.

10. An enhanced personal cooling garment as defined in claim 2 wherein said inner layer is stretchable under normal operating conditions to improve said snug fit with said wearer.

11. An enhanced personal cooling garment as defined in claim 3 wherein said inner layer is stretchable under normal operating conditions to improve said snug fit with said wearer.

12. An enhanced personal cooling garment as defined in claim 4 wherein said inner layer is stretchable under normal operating conditions to improve said snug fit with said wearer.

13. An enhanced personal cooling garment as defined in claim 5 wherein said inner layer is stretchable under normal operating conditions to improve said snug fit with said wearer.

14. An enhanced personal cooling garment as defined in claim 6 wherein said inner layer is stretchable under normal operating conditions to improve said snug fit with said wearer.

15. An enhanced personal cooing garment as defined in claim 7 wherein said inner layer is stretchable under normal operating conditions to improve said snug fit with said wearer.

16. An enhanced personal cooling garment as defined in claim 8 wherein said inner layer is stretchable under normal operating conditions to improve said snug fit with said wearer.

17. An enhanced personal cooling garment as defined in claim 2 further comprising a tubing network inter connecting said wherein bladders with a source of water under pressure.

18. An enhanced personal cooling garment as defined in claim 4 further comprising a tubing network inter connecting said wherein bladders with a source of water under pressure.

19. An enhanced personal cooling garment as defined in claim 10 further comprising a tubing network inter connecting said wherein bladders with a source of water under pressure.

20. An enhanced personal cooling garment as defined in claim 12 further comprising a tubing network inter connecting said wherein bladders with a source of water under pressure.

* * * * *